US005681689A

United States Patent [19]

Lau et al.

[11] Patent Number: 5,681,689

[45] Date of Patent: Oct. 28, 1997

[54] PHOTOGRAPHIC MATERIAL CONTAINING ACRYLATE OR ACRYLAMIDE BASED YELLOW DYE-FORMING COUPLERS

[75] Inventors: Philip T. S. Lau; Stanley Wray Cowan, both of Rochester, N.Y.

[73] Assignee: Eastman Kodak Company, Rochester, N.Y.

[21] Appl. No.: 644,809

[22] Filed: May 10, 1996

[51] Int. Cl.[6] ..... G03C 7/32; G03C 7/36

[52] U.S. Cl. ..... 430/543; 430/552; 430/553; 430/558; 430/955

[58] Field of Search ..... 430/552, 553, 430/558, 543, 544, 955

[56] References Cited

U.S. PATENT DOCUMENTS

| | | | |
|---|---|---|---|
| 5,460,927 | 10/1995 | Williamson | 430/543 |
| 5,470,696 | 11/1995 | Williamson | 430/543 |

FOREIGN PATENT DOCUMENTS

| | | | |
|---|---|---|---|
| 1072241 | 4/1986 | Japan | 430/543 |
| 92/02293 | 2/1992 | WIPO . | |
| 93/07534 | 2/1992 | WIPO . | |
| 9301523 | 1/1993 | WIPO | 430/543 |

*Primary Examiner*—Lee C. Wright
*Attorney, Agent, or Firm*—Arthur E. Kluegel

[57] ABSTRACT

The invention provides a photographic material comprising at least one light sensitive silver halide emulsion layer having associated therewith a yellow dye forming coupler having formula (I) or (II):

(I)

(II)

wherein

R represents an aromatic or heterocyclic group containing a group ionizable at pH 10 that is in conjugation with the double bond between the carbons to which A and X are respectively bonded through a π-electron network;

A is selected from the group consisting of hydrogen, a cyano group, an alkyl group, an aryl group, an alkylsulfonyl group, and an arylsulfonyl group;

B is an alkyl group or an aryl group; and

X represents hydrogen or a group capable of being split off upon coupling with oxidized color developer.

21 Claims, 1 Drawing Sheet

PHOTOGRAPHIC MATERIAL CONTAINING ACRYLATE OR ACRYLAMIDE BASED YELLOW DYE-FORMING COUPLERS

CROSS REFERENCE TO RELATED APPLICATION

Reference is made to and priority claimed from U.S. provisional application Ser. No. 60/002,263, filed 14 Aug. 1995, entitled PHOTOGRAPHIC MATERIAL CONTAINING ACRYLATE OR ACRYLAMIDE BASED YELLOW DYE-FORMING COUPLERS.

FIELD OF THE INVENTION

This invention relates to photographic materials having a light sensitive silver halide emulsion layer which has associated therewith an acrylate or acrylamide based yellow dye-forming coupler.

BACKGROUND OF THE INVENTION

The subtractive process of color formation is customarily employed in multi-colored photographic elements. The resulting yellow, magenta, and cyan image dyes are formed in silver halide layers sensitive to blue, green, and red radiation, respectively. It is well known in the photographic art that these color images are customarily obtained by a coupling reaction between an oxidized aromatic primary amine developer and a color-forming coupler. It is important that the dye formed from the color-forming couplers have the proper light absorption characteristics. Thus, ideally, the yellow dye should have a high absorption for blue radiation and no or very low absorption for green and red radiation.

Typically, yellow dye-forming couplers are open-chain ketomethylene compounds which yield azomethine dyes upon coupling with oxidized developers. The most common yellow dye-forming couplers are acylacetanilides such as pivaloylacetanilides and benzoylacetanilides. Representative couplers of these classes are described in U.S. Pat. Nos. 2,298,443; 2,407,057; 2,875,057; 3,048,194; 3,265,506; 3,447,928; 4,157,919; 4,230,851; 4,327,175; 4,401,752; and 4,529,691. Furthermore, "Farbkupplereine Literaturubersicht"published in Agfa Mittelunger, Band II, pp 112–126 (1961) describes such couplers.

The dyes formed by these known yellow dyeforming couplers frequently used in the photographic art often do not possess the absorption characteristics discussed above to the desired extent. In particular, they are bathochromically shifted, so that they absorb not only blue light, but often undesirable quantities of green light, which results in orange hues. Furthermore, pivaloylacetanilide yellow couplers have in general low coupler efficiency due to their high pKa value, and benzoylacetanilide yellow couplers form yellow image dyes that have very poor light fastness.

International Patent Application No. WO92/02293 discloses a class of magenta dye-forming couplers of the general formula:

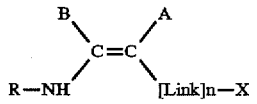

wherein

A and B represent the same or different electron-withdrawing groups,

X is H or a group which splits off on coupling with oxidized color developer,

R is an alkyl, cycloalkyl, aryl or heterocyclic group any of which may be substituted, —$COR^1$, —$CSR^1$, —$SOR^1$, —$SO_2R^1$, —$NHCOR^1$, —$CONHR^1$, —$COOR^1$, —$COSR^1$, —$NHSO^2R^1$ wherein $R^1$ is an alkyl, cycloalkyl, or aryl group any of which are optionally substituted, and wherein two or more of A, B, R, and X optionally form part of a ring, Link is a linking group and n is 0, 1, or 2.

Distinctive features of this class of couplers are, for example, the presence of an amino group that is directly attached to the carbon-carbon double bond, and the required presence of the electron-withdrawing groups A and B on each of the doubly-bonded carbon atoms. The end result is a magenta coupler which is not suitable to provide the desired yellow dye forming coupler.

Accordingly, there has been a need to provide a photographic element containing yellow-dye forming couplers which do not have the inherent disadvantages of the known couplers. In particular, it would be highly desirable to develop a yellow-dye forming coupler which has a more favorable absorption of blue light compared to green or red light.

SUMMARY OF THE INVENTION

The invention provides a photographic material comprising at least one light sensitive silver halide emulsion layer having associated therewith a yellow dye forming coupler having formula (I) or (II):

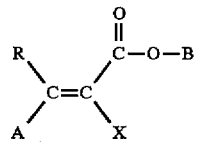

(I)

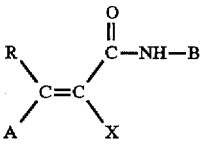

(II)

wherein

R represents an aromatic or heterocyclic group containing a group ionizable at pH 10 that is in conjugation with the double bond between the carbons to which A and X are respectively bonded through a π-electron network;

A is selected from the group consisting of hydrogen, a cyano group, an alkyl group, an aryl group, an alkylsulfonyl group, and an arylsulfonyl group;

B is an alkyl group or an aryl group; and

X represents hydrogen or a group capable of being split off upon coupling with oxidized color developer.

The invention also provides a method for forming an image.

Photographic elements of the invention do not have the inherent disadvantages of the known couplers, and in particular, they have a more favorable absorption of blue light compared to green or red light.

DETAILED DESCRIPTION OF THE INVENTION

Figure 1:
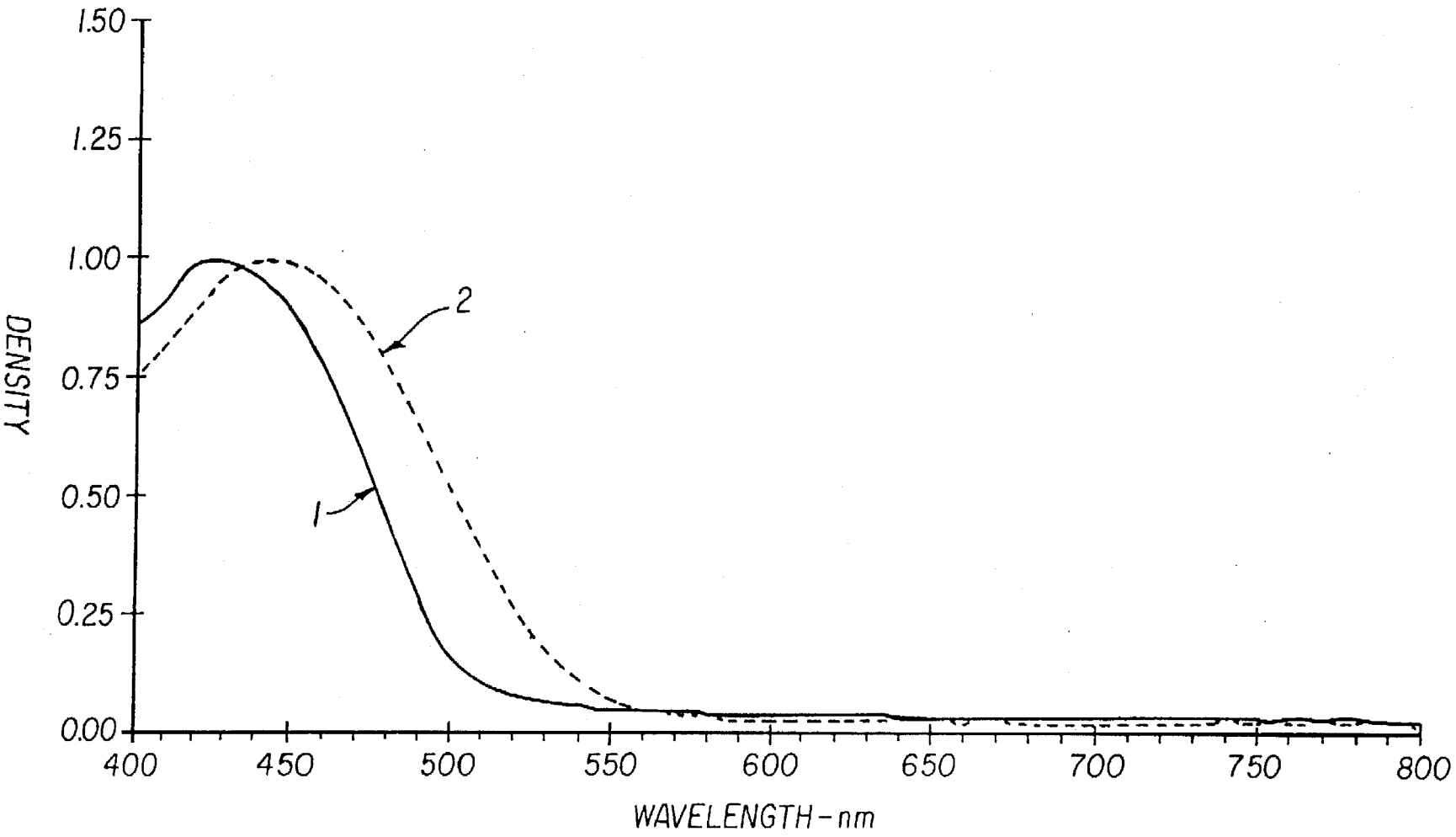
FIG. 1 shows an absorption curve of a photographic element of the invention (1) and an absorption curve of a comparison photographic element (2).

An advantage of the photographic element of the invention is that the yellow couplers having the indicated conjugated chromophore have excellent spectral characteristics such as absorption wavelength (γ-max) and a sharp-cutting absorption curve with little or no unwanted absorption of green light. Further there are numerous sites for substituent variations on the coupler to enable one to tailor the chemical and photographic performance of these couplers depending on the particular application contemplated.

In formulas (I) and (II) above, R represents an aromatic or heterocyclic group containing a group ionizable at pH 10 that is in conjugation with the double bond between the carbons to which A and X are respectively bonded through a π-electron network to the acrylate or acrylamide parent molecule. The aromatic or heterocyclic group may be monocyclic or polycyclic.

The ionizable group contained in R is a group which is readily ionizable under the pH 10 conditions of the developing bath without deleteriously affecting the photographic imaging process. The ionizable substituent in R is, for example, a hydroxyl group, an alkylsulfonamido group, an arylsulfonamido group, or a heterocyclicamino group. The hydrogen atom associated with these groups must be acidic enough to be readily ionized in a photographic color developer solution of pH 10 or greater so that the anion that is formed is capable of activating the coupling site through the π-electron conjugated network.

R may be, for example, a 2-or 4-hydroxyphenyl group, a 2-or 4-sulfonamidophenyl group, a 4-hydroxynaphthyl group, a 4-sulfonamidonaphthyl group, a 3-indolyl group, a 4-pyrazolyl group, a 3-pyrazolotriazolyl group, or a 7-pyrazolotriazolyl group.

In addition to the ionizable group, R may contain other substituents as exemplified by a halogen atom such as a chlorine, fluorine, or bromine; a cyano group; an alkyl group such as a methyl, ethyl, or octadecyl group; an alkoxy group such as a methoxy, butoxy, or pentadecyloxy group; an acylamino group such as a 2,4-di-t-pentylphenoxyacetamino group; a carbamoyl group such as a 4-(2,4-di-t-pentylphenoxy)butylaminocarbonyl group; an alkoxycarbonyl group such as a tetradecyloxycarbonyl group; an alkoxycarbonylamino group such as a dodecyloxycarbonylamino group; an alkylsulfonyl group such as a methylsulfonyl, octylsulfonyl, or hexadecylsulfonyl group; an arylsulfonyl group such as a phenylsulfonyl or dodecyloxyphenylsulfonyl group; a sulfonamido group such as a hexadecylsulfonamido or 4-dodecyloxyphenylsulfonamido group; or a sulfamoyl group such as a methanesulfamoyl or tetradecanesulfamoyl group.

In formula (I) or (II), A is hydrogen, a cyano group, an alkyl group, an aryl group, an alkylsulfonyl group, or an arylsulfonyl group. For example, A may be a hydrogen atom; a cyano group; a perfluoroalkyl group such as a trifluoromethyl or heptafluoropropyl group; an alkyl group such as a methyl, ethyl or octadecyl group; an aryl group such as a phenyl, 4-cyanophenyl, 4-methoxyphenyl, or pentafluorophenyl group; an alkylsulfonyl group such as a methylsulfonyl, butylsulfonyl or dodecylsulfonyl group; or an arylsulfonyl group such as a phenylsulfonyl or dodecyloxyphenylsulfonyl group.

In formula (I) or (II), B is an alkyl group or an aryl group. For example, B may be an alkyl group such as methyl, t-butyl, octadecyl, perfluorotetradecyl, 4-(2,4-di-t-penylphenoxy)butyl, or 4-(3-pentadecylphenoxy)butyl group; an aryl group such as phenyl, 2-tetradecyloxyphenyl, 3-octadecylsulfonylphenyl, 3-hexadecylsulfonamidophenyl, 2-chloro-5-dodecyloxycarbonylphenyl, or 4-dodecylsulfonyl-2,3,5,6-tetrafluorophenyl group.

In formula (I) or (II), X is a hydrogen atom or a group (herein referred to as a "coupling-off group") which can be split off by the reaction of the coupler with an oxidized color developer. Coupling-off groups are known to those skilled in the art. Such groups can determine the equivalency of the coupler, can modify the reactivity of the coupler, or can advantageously affect the layer in which the coupler is coated or other layers in the element by performing, after release from the coupler, such functions as development inhibition, development acceleration, bleach inhibition, bleach acceleration, color correction, and the like. Representative classes of coupling-off groups include halogen, particularly chlorine, bromine, or fluorine; alkoxy, aryloxy, or heterocyclyoxy groups; heterocyclic groups such as hydantoin and pyrazolo groups; sulfonyloxy groups; acyloxy groups; carbonamido groups; imido groups; acyl groups; heterocyclylimido groups, thiocyano groups, alkylthio groups, arylthio groups, heterocyclylthio groups, sulfonamido groups, phosphonyloxy groups, and arylazo groups. They are described in, for example, U.S. Pat. Nos. 2,355,169, 3,227,551, 3,432,521, 3,476,563, 3,617,291, 3,880,661, 4,052,212, and 4,134,776; and in UK patents and published application numbers 1,466,728, 1,531,927, 1,533,039, 2,006,755A, and 2,017,704A; the disclosures of which are incorporated herein by reference.

The invention provides a photographic material containing a yellow coupler capable of being prepared from readily available starting materials and at the same time capable of providing many sites for substituent variations to achieve desirable chemical and photographic properties. The invention relates in part to the use of the above described couplers in molecules from which photographically useful groups can be released. Such molecules are of the structure described above, in which X is $$-(TG)_x\text{-}PUG$$

wherein TG is a timing group cleavable from the rest of the coupler during processing;

x is 0, 1, 2, or 3; and

PUG is a releasable photographically useful group.

Any timing group which is known in the photographic art is useful as the timing group TG. Exemplary timing groups are disclosed in U.S. Pat. Nos. 4,248,962, 4,772,537, 5,019,492, and 5,026,628 and European Patent Application No. 255,085. Up to three timing groups can be joined sequentially (that is, x is 0 to 3). The timing group can be unballasted or ballasted, and can contain solubilizing groups.

Useful PUGs include any known in the art, such as development inhibitors, dyes, dye precursors, additional couplers, developing agents, development accelerators, bleach inhibitors, bleach accelerators, stabilizers, nucleators, fixing agents, complexing agents, image toners, image stabilizers, tanning agents, solvents, surfactants, chemical and spectral sensitizers, hardeners, fogging agents, antifoggants, UV absorbers and stabilizers, and other additives known to be useful in photographic materials. These PUGs are well known in the art, and are described, for example, in U.S. Pat. Nos. 5,019,492 and 5,026,628, which are both incorporated herein by reference in their entireties.

The novel couplers of the present invention can be used as masking couplers in a layer of a photographic material. Masking couplers are compounds which serve to provide optical density of a color which varies in proportion to the level of exposure to offset an undesired side absorption of an image dye formed during development. When used as a masking coupler, a coupler wherein X has the above structure -(TG)$_x$-PUG is used wherein PUG is a dye. The type of dye is selected, as is known, so as to facilitate the desired masking. The dye may be attached to TG, or directly to the coupler if x is zero, at any location except through the auxochrome of the dye. The auxochromic group of the dye may be blocked by any removable group known in the art. Through blocking, the hue can be shifted outside of the visible range so that the desired masking effect is obtained without the unwanted absorption of light which often results in a speed loss in the color of the absorbed light. The blocking group may be any group which is removable during processing. Examples of useful blocking groups are disclosed in UK Patent Application 2,105,482, with particularly effective blocking groups described in U.S. Pat. No. 5,019,492.

Examples of specific coupling-off groups are F, Cl, Br, —$OCH_3$, —$OC_6H_5$, —$SCH_2CH_2COOH$, —$OCH_2CONHCH_2CH_2OH$,

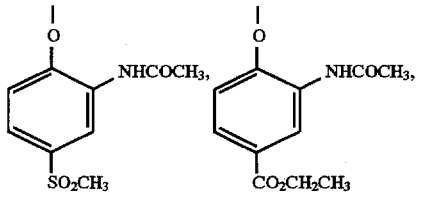

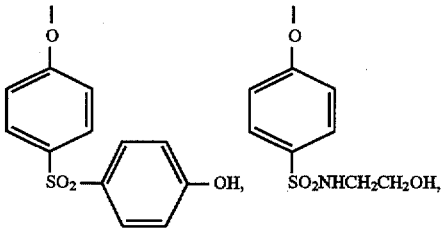

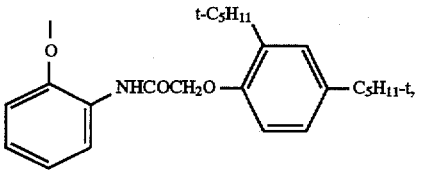

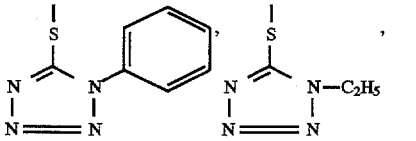

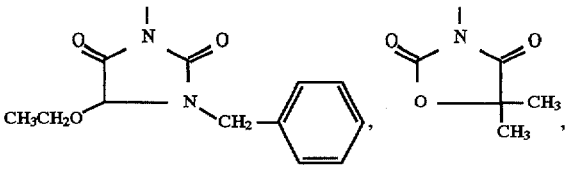

-continued

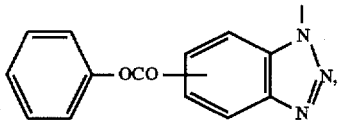

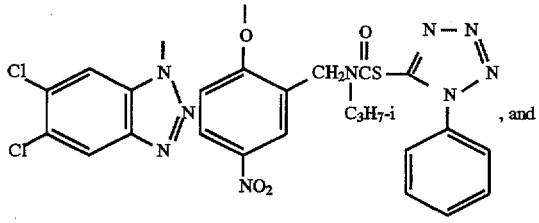

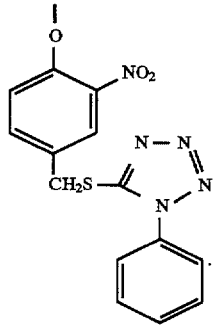

At least one of the groups R, A, B, and X in formulas I and II should contain a ballast group. The ballast can be any group of sufficient size and bulk that, with the remainder of the molecule, it renders the unreacted molecule immobile or non-diffusible in the photographic element prior to processing. It can be a relatively small group if the remainder of the molecule is relatively bulky. Preferably, the ballast is an alkyl or aryl group containing about 10 to 40 carbon atoms. These groups can be unsubstituted or substituted with groups which, for example, control the degree of diffusability of the coupler prior to development. A ballast can be attached to any part of the coupler, including the TG and/or the PUG. The ballast can also contain additional solubilizing groups such as carboxylic acids or sulfonamides. Suitable ballast groups are described in, for example, U.S. Pat. No. 4,420,556 and 4,923,789, which are incorporated herein by reference.

The term "alkyl group" as used herein with respect to groups R, A, B, and X in formulas (I) and (II), indicates a linear, branched or cyclic hydrocarbon group which may be substituted or unsubstituted, and may be saturated or unsaturated. The term "aryl group" as similarly used indicates a phenyl or naphthyl ring which may be substituted or unsubstituted.

The following examples represented by formulas (I) and (II) further illustrate the invention. It is not to be construed that the present invention is limited by these examples.

M-1

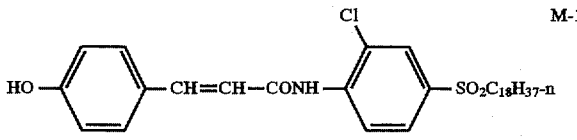

M-2

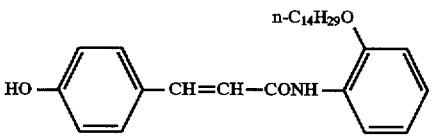

-continued
M-3
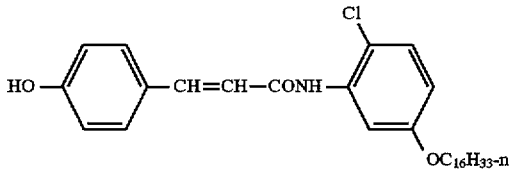
M-4
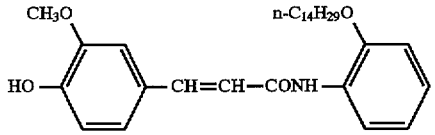
M-5
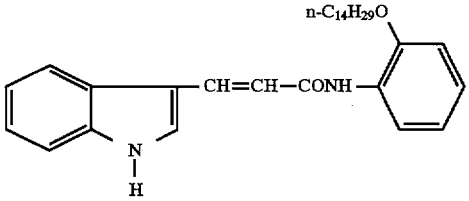
M-6
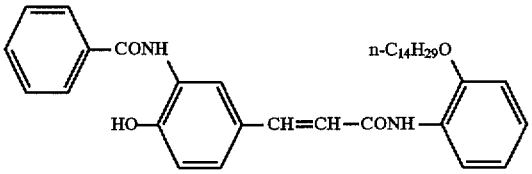
M-7
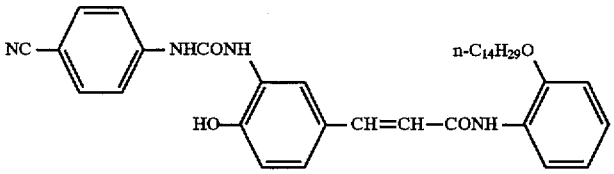
M-8
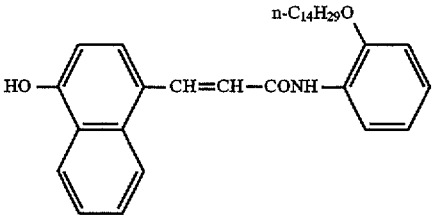
M-9
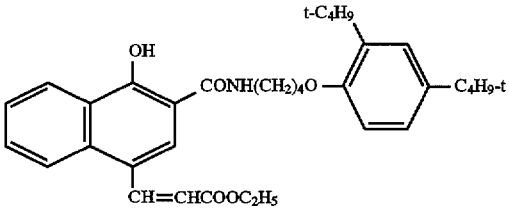
M-10
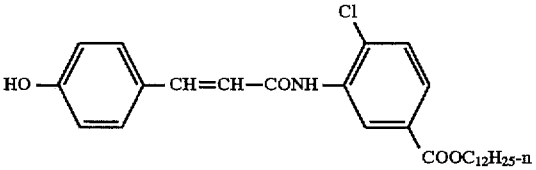
M-11
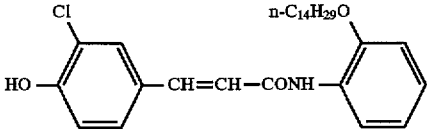
M-12
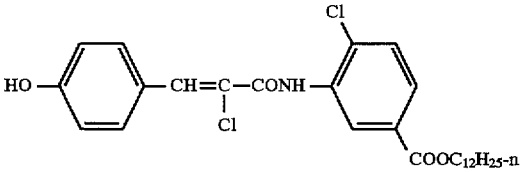
M-13
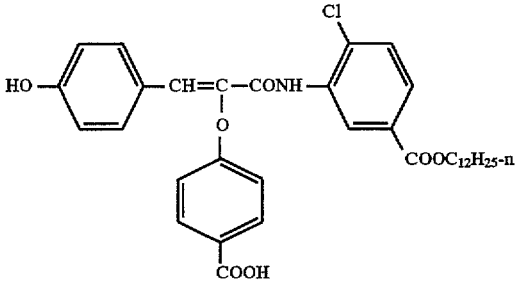
M-14
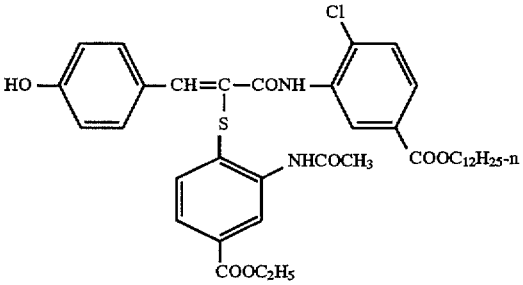
M-15
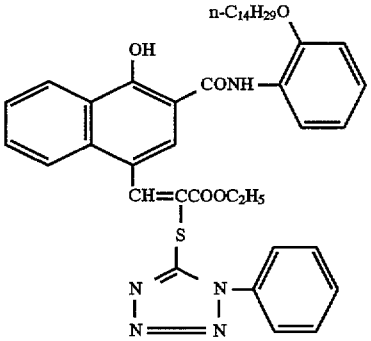

-continued
M-16
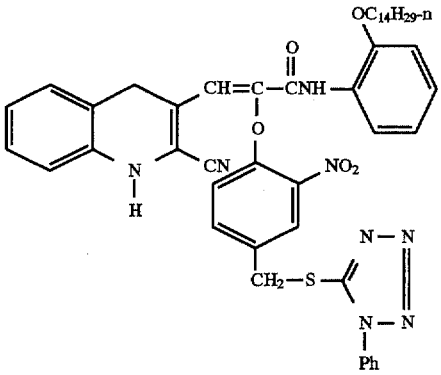
M-17
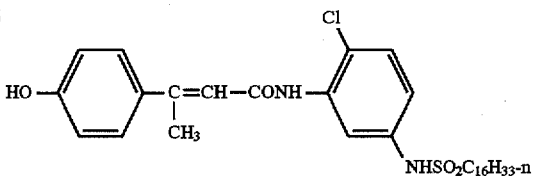
M-18
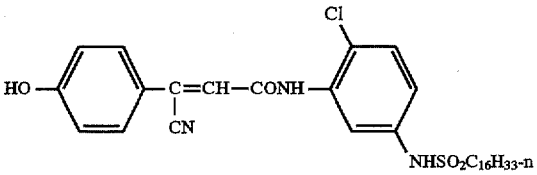
M-19
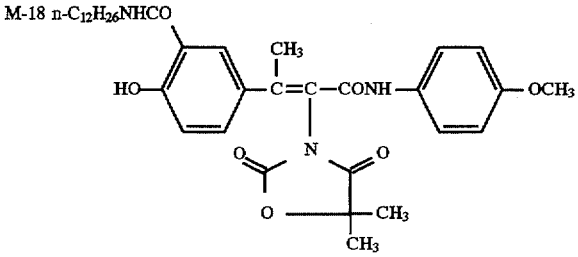
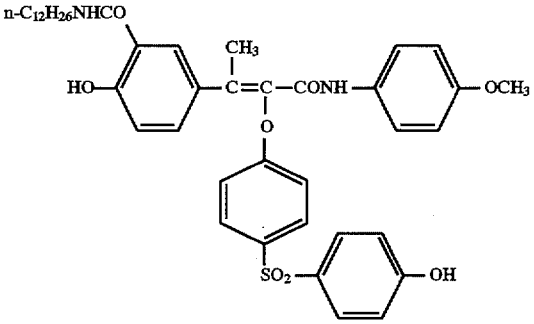
M-20
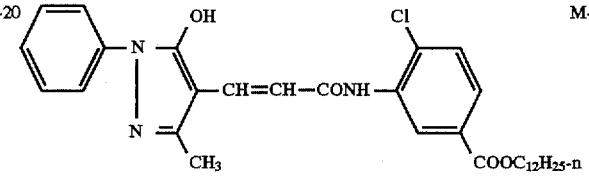
M-21
M-22
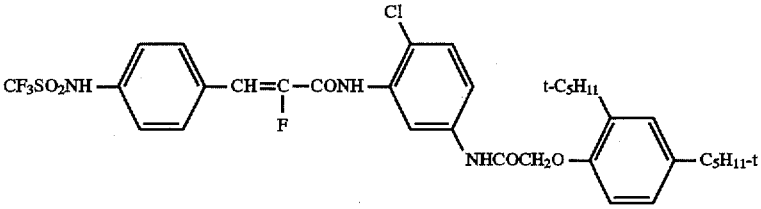
M-23
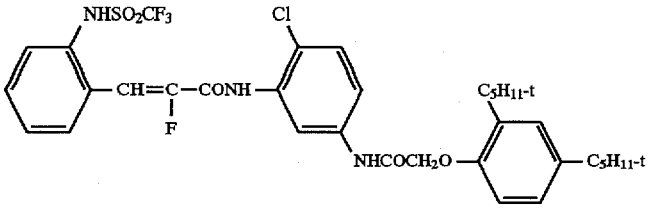

-continued
M-24
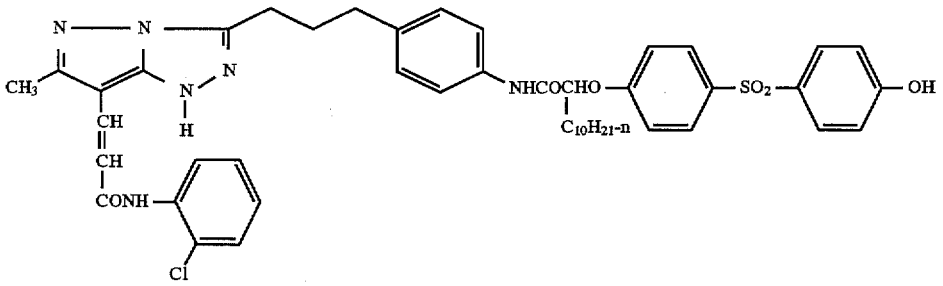
M-25
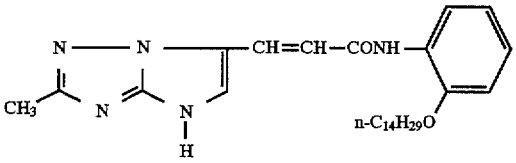
M-26
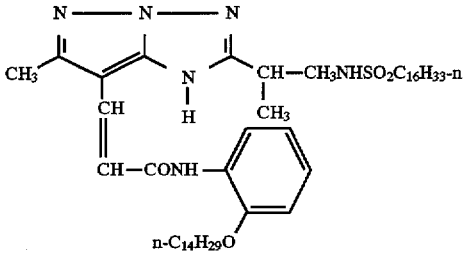
M-27
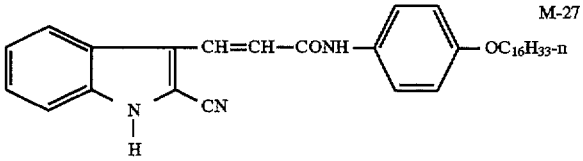
M-28
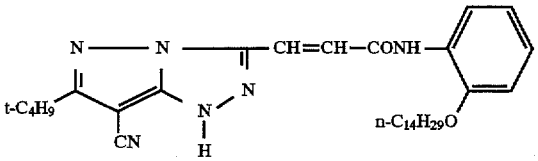
M-29
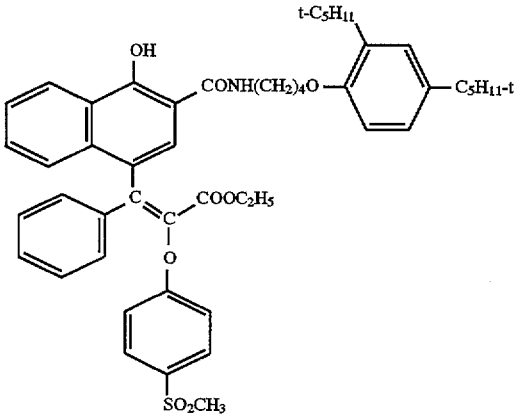
M-30
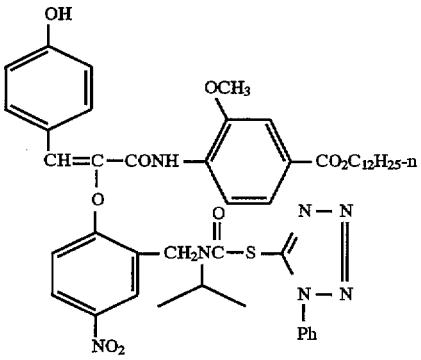
M-31
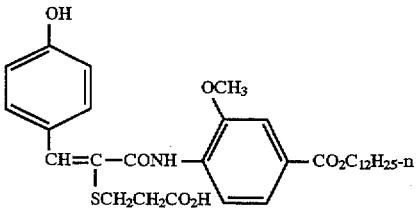
M-32
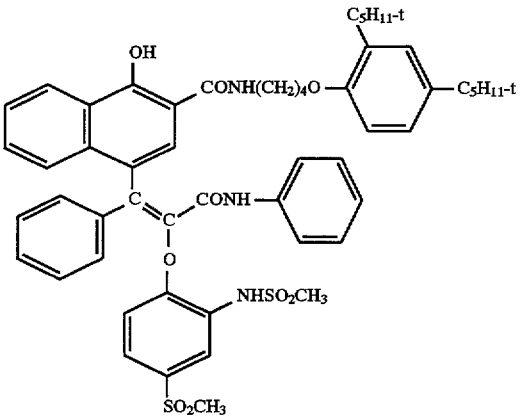

-continued

M-33

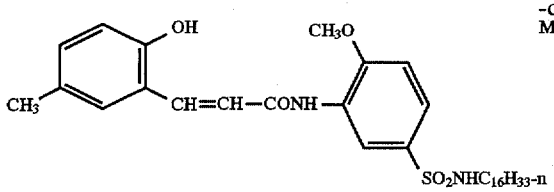

M-34

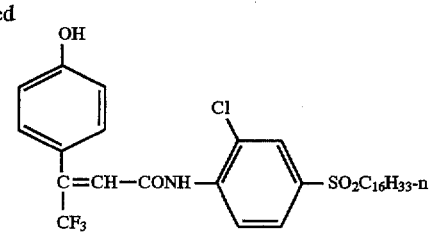

M-35

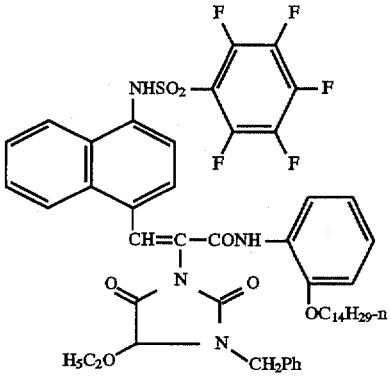

M-36

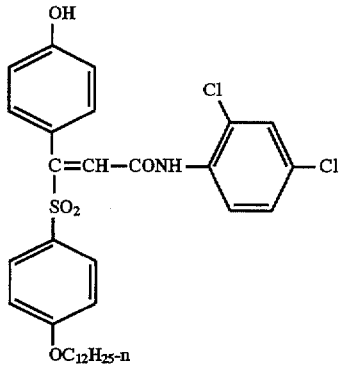

M-37

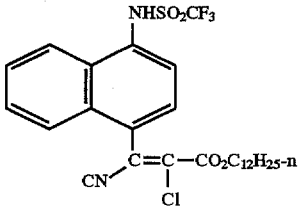

M-38

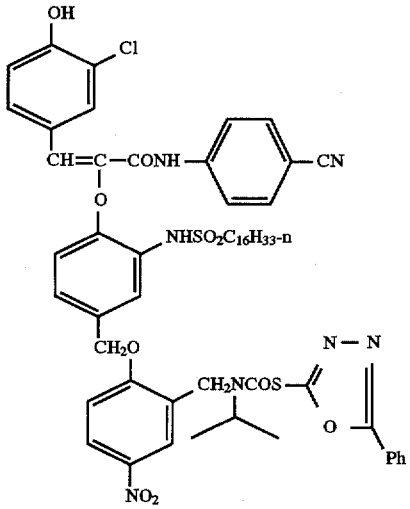

M-39

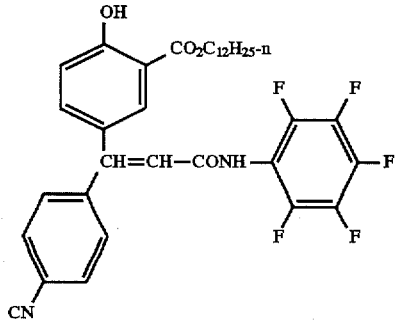

M-40

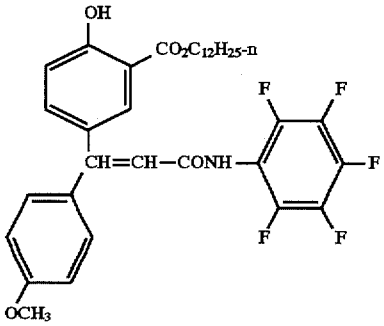

The compounds of the present invention can be easily prepared by known methods described in Collective Volume 3, p. 425 (1955); *Organic Synthesis*, Collective Volume 4, p. 327 (1956); *Journal of the American Chemical Society* 77, 1067 (1955); and *Journal of the American Chemical Society* 78, 1367 (1956). Most of the 3-substituted acrylic acids are available from commercial sources or they can be readily prepared from the appropriate aldehydes and malonic acid in the presence of a base. If desired "B" may be linked to one or more additional yellow dye-forming couplers (e.g. through an alkylene or polyalkylene oxide link) or to a polymeric backbone.

Typical methods of preparing couplers M-2, M-5, and M-11 of the invention are described in the synthesis examples. Other couplers of the invention can be prepared in similar fashion.

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecylphenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobe or "ballast" group in coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12*a* North Street, Emsworth, Hampshire P010 7DQ, ENGLAND, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1994, Item 36544, available as described above, which will be identified hereafter by the term "Research Disclosure" The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX. Certain desirable photographic elements and processing steps, particularly those useful in conjunction with color reflective prints, are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: UK. Patent Nos. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Patent Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2-or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No, 4,301,235; U.S. Pat. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58–172,647; U.S. Pat. Nos. 2,983,608; 4,070,191; and 4,273,861; German Applications DE 2,706,117 and DE 2,643,965; UK. Patent 1,530,272; and Japanese Application 58–113935. The masking couplers may be shifted or blocked, if desired.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. 4,163,669; U.S. Pat. No. 4,865,956; and U.S. Pat. No. 4,923,784, may be useful. Also contemplated is use of the compositions in association with nucleating agents, development accelerators or their precursors (UK Pat. No. 2,097,140; UK. Patent 2,131,188); electron transfer agents (U.S. Pat. No. 4,859, 578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543, 323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384, 657; 3,379,529; 3,615,506; 3,617,291; 3,620,746; 3,701, 783; 3,733,201; 4,049,455; 4,095,984; 4,126,459; 4,149, 886; 4,150,228; 4,211,562; 4,248,962; 4,259,437; 4,362, 878; 4,409,323; 4,477,563; 4,782,012; 4,962,018; 4,500, 634; 4,579,816; 4,607,004; 4,618,571; 4,678,739; 4,746, 600; 4,746,601; 4,791,049; 4,857,447; 4,865,959; 4,880, 342; 4,886,736; 4,937,179; 4,946,767; 4,948,716; 4,952, 485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

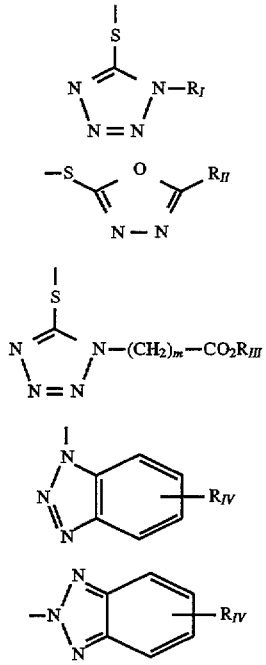

wherein $R_I$ is selected from the group consisting of straight and branched alkyls of from 1 to about 8 carbon atoms, benzyl, phenyl, and alkoxy groups and such groups containing none, one or more than one such substituent; $R_{ii}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group, which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. No. 4,409,323; 4,421,845; Japanese Applications 57-188035; 58-98728; 58-209736; 58-209738) groups utilizing ester hydrolysis (German Patent Application (OLS)

No. 2,626,315); groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above. It is typical that the timing group or moiety is of one of the formulas:

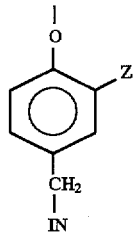

-continued

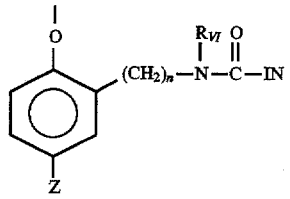

wherein IN is the inhibitor moiety, Z is selected from the group consisting of nitro, cyano, alkylsulfonyl; sulfamoyl ($—SO_2NR_2$); and sulfonamido ($—NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

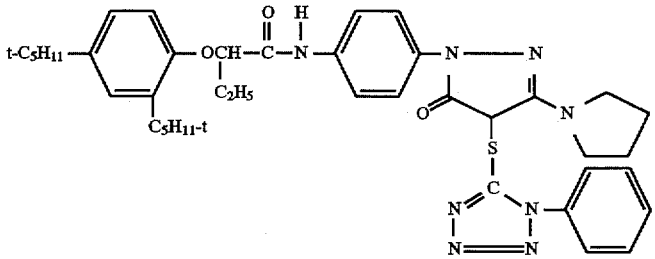

D2

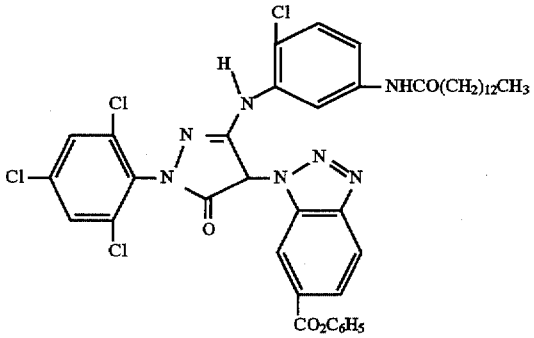

D3

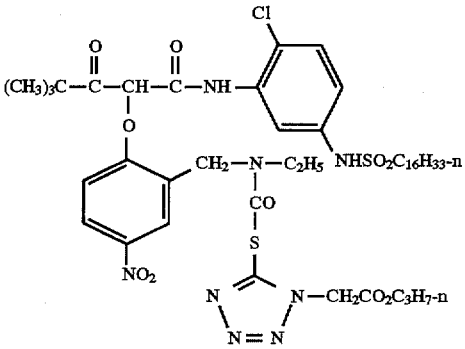

D4

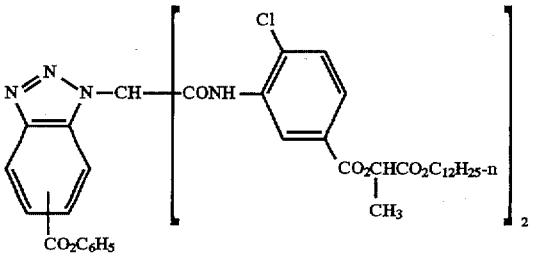

D5

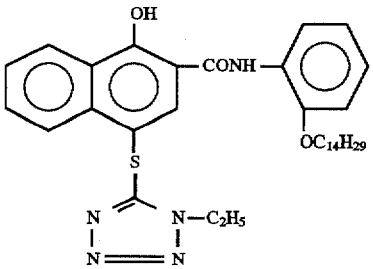

-continued

D6

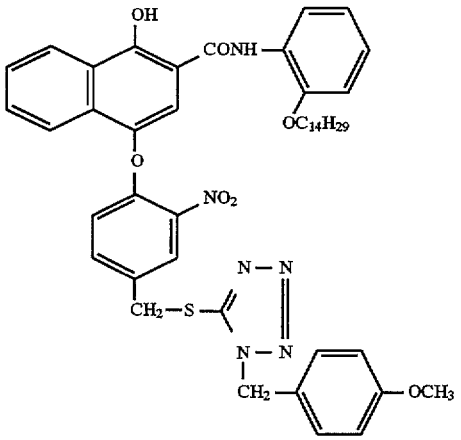

D7

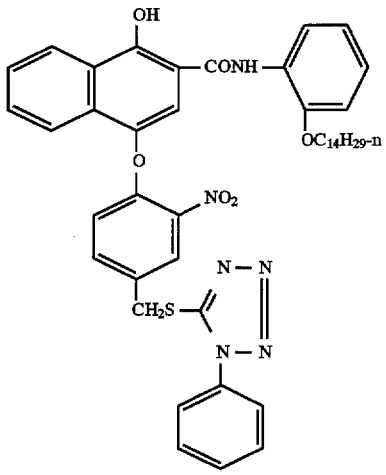

D8

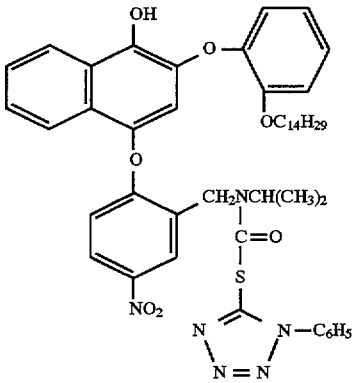

D9

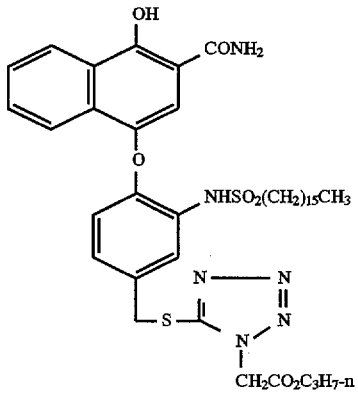

D10

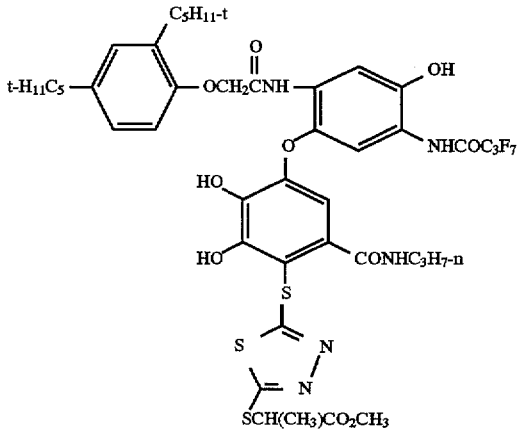

It is also contemplated that the concepts of the present invention may be employed to obtain reflection color prints as described in *Research Disclosure*, November 1979, Item 18716, available from Kenneth Mason Publications, Ltd, Dudley Annex, 12*a* North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 9072,632; 90-072,633; 90-072,634; 90-077,822; 9078,229; 90-078,230; 90-079,336; 90-079 337; 9079,338; 90-079,690; 90-079,691; 90-080 487; 9080,488; 90-080,489; 90-080,490; 90-080 491; 9080,492; 90-080 494; 90-085,928; 90-086 669; 9086,670; 90-087 360; 90-087,361; 90-087 362; 9087,363; 90-087 364; 90-088,097; 90-093 662; 9093,663; 90-093 664; 90-093,665; 90-093,666; 9093,668; 90-094,055; 90-094,056; 90-103,409; 83-62,586; 83-09,959.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.06 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known Kodak C-41 color process as described in The British Journal of Photography Annual of 1988, pages 191–198. Where applicable, the element may be processed in accordance with color print processes such as the RA-4 process of Eastman Kodak Company as described in the British Journal of Photography Annual of 1988, Pp 198–199. Such negative working emulsions are typically sold with instructions to process using a color negative method such as the mentioned C-41 or RA-4 process. To provide a positive (or reversal) image, the color development step can be preceded by development with a non-chromogenic developing agent to develop exposed silver halide, but not dye, and followed by uniformly fogging the element to render unexposed silver halide developable. Such reversal emulsions are typically sold with instructions to process using a color reversal process such as E-6. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamido-ethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the various copending applications as well as patents and other publications cited in this specification are incorporated herein by reference.

SYNTHESIS EXAMPLES

Preparation of Coupler M-2

To a stirred solution of 8.2 g (0.05 mol) 4-hydroxycinnamic acid and 15.3 g (0.05 mol) 2-tetradecyloxyaniline in 100 mL tetrahydrofuran (THF) was added in one portion 10.3 g (0.05 mol) 1,3-dicyclohexylcarbodiimide dissolved in 25 mL THF. The mixture was stirred at room temperature overnight. The mixture was filtered to remove the solid by-product, dicyclohexylurea. The filtrate was poured into ice-water containing 2 mL HCl. The solid which separated was collected, washed with water, and recrystallized from acetonitrile to give 20.6 g (91%) of white crystalline solid; m.p. 102–103C. Its $H^1$ NMR spectrum was consistent with structure M-2.

Calcd. for $C_{29}H_{41}NO_3$: C,77.12; H,9.15, N,3.10

Found: C,77.05; H,9.20; N,3.21

Preparation of Coupler M-5

To a stirred solution of 9.4 g (0.05 mol) 3-indoleacrylic acid and 15.3 g (0.05 mol) 2-tetradecyloxyaniline in 100 mL THF was added in one portion 10.3 g (0.05 mol) 1,3-dicyclohexylcarbodiimide dissolved in 25 mL THF.The mixture was stirred at room temperature for 3 hours. The solid by-product, dicyclohexylurea, was removed by filtration. The filtrate was then drowned in water containing 2 mL HCl. The solid which precipitated out was collected, washed with water, and recrystallized from ethanol to give 18.3 g (77%) of white crystalline product; m.p. 103–104C. Its $H^1$ NMR spectrum was consistent with structure M-5.

Calcd. for $C_{31}H_{42}N_2O_2$: C,78.44; H,8.92, N,5.90

Found: C,78.30; H,8.76; N,5.85

Preparation of 3-(3-chloro-4-hydroxphenyl)acrylic acid

To a stirred solution of 12.5 g (0.08 mol) 3-chloro-4-hydroxyphenylbenzaldehyde in 70 mL pyridine was added in one portion 16.7 g (0.16 mol) malonic acid. The mixture was heated on a steam bath until complete solution was achieved. To the hot mixture was added 6–7 drops of piperidine. The mixture was heated with stirring for 4 hours until tlc ($CH_2Cl_2$:EtOAc, 9:1) showed that all the starting aldehyde had been consumed. After cooling to room temperature the mixture was poured into water. The gummy product mixture was separated, washed with dilute HCl and triturated with water until it solidified. Recrystallization from acetonitrile-water gave 11.8 g (73.4%) of white solid; m.p. 180–182C.

Calcd. for $C_9H_7ClO_3$: C,54.43; H,3.55

Found: C,54.58; H,3.65

Preparation of Coupler M-11

To a stirred solution of 9.8 g (0.05 mol) 3-(3-chloro-4-hydroxyphenyl)acrylic acid, prepared as described above, and 15.3 g (0.05 mol) 2-tetradecyloxyaniline in 100 mL THF was added in one portion a solution of 10.3 g (0.05 mol) 1,3-dicyclohexylcarbodiimide in 25 mL THF. The mixture was stirred at room temperature overnight. The precipitated dicyclohexylurea by-product was removed by filtration and the filtrate was then poured into water containing 2 mL HCl . The solid was collected, washed with water, and recrystallized form ethanol to give 17.7 g (73%) of white crystalline product; m.p. 95–96C. Its $H^1$ NMR spectrum was consistent with structure M-11.

Calcd. for $C_{29}H_{40}ClNO_3$:C,71.66; H,8.29, N,2.88

Found: C,72.01; H,8.21; N,2.88

PHOTOGRAPHIC EXAMPLES

Film Coating Example 101 (Comparison)

On a cellulose acetate-butyrate support were coated the following layers:

First Layer

A blue-sensitive emulsion layer comprising 3.77 grams gelatin, 0.78 grams silver bromoiodide emulsion (expressed as silver), $2.69\times10^{-6}$ mole (2.45 grams) comparison coupler CC-1, and 1.22 grams dibutyl phthalate per square meter.

Second Layer

A protective layer containing 2.69 grams gelatin and 0.12 gram bis(vinylsulfonyl)methane per square meter.

CC-1

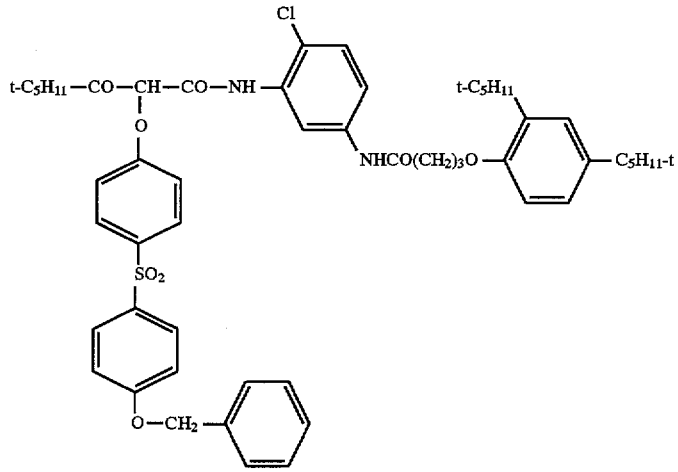

Film Coating Examples 102–109 (Invention)

The couplers of the invention shown in Table 1 were coated in the same manner as the comparison coupler in Coating Example 101, except that the First Layer of each coating contained 1.55 grams emulsion and $2.69\times10^{-6}$ mole coupler per square meter, and dibutyl phthalate equal to half the weight of coupler. (The amount of emulsion was increased to adjust for the equivalency of the couplers.)

Processed Film Samples 201–209

Samples 201–209 were prepared by exposing the coatings of Examples 101–109 through a step wedge and processing as follows:

| Process Step | Time (min.) | Temp. (C.) |
|---|---|---|
| Developer | 2.75 | 37.8 |
| Stop Bath | 0.30 | 37.8 |
| Bleach | 4.00 | 37.8 |
| Water wash | 3.00 | 37.8 |
| Fixer | 4.00 | 37.8 |
| Water wash | 3.00 | 37.8 |

The processing solutions used in the above process had the following compositions (amounts per liter of solution):

| Developer | |
|---|---|
| Potassium carbonate | 37.50 g |
| Sodium sulfite | 4.00 g |
| Potassium iodide | 1.20 mg |
| Sodium bromide | 1.30 g |
| 1,3-Diamino-2-propanoltetraacetic acid | 2.50 g |
| Hydroxylamine sulfate | 2.00 g |

-continued

| | |
|---|---|
| 4-Amino-3-methyl-N-ethyl-N-beta-hydroxy ethylaniline sulfate | 4.50 g |
| pH adjusted to 10.00 at 26.7 C. | |
| Stop bath | |
| Sulfuric acid | 10.00 g |
| Bleach | |
| Ammonium bromide | 150.00 g |
| Ammonium ferric ethylenediaminetetra acetate | 77.0 g |
| Ethylenediaminetetraacetic acid | 6.13 g |
| Acetic acid | 9.50 mL |
| Sodium nitrate | 35.00 g |
| pH adjusted to 6.00 at 26.7 C. | |
| Fixer | |
| Ammonium thiosulfate | 91.53 g |
| Ammonium sulfite | 6.48 g |
| Sodium metabisulfite | 1.00 g |
| pH adjusted to 6.50 at 26.7 C. | |

The spectra of the resulting dyes were measured and normalized to a maximum absorption of 1.00. The wavelength of maximum absorption (Abs. Max.), bandwidth at 50% peak height, and the absorption at 500 nanometers (Abs@500) are shown in Table 1.

TABLE 1

| Coating Example | Processed Sample | Coupler | Abs. Max. (nm) | Bandwidth (nm) | Abs @ 500 |
|---|---|---|---|---|---|
| 101 | 201 | CC-1 | 449 | 90 | .35 |
| 102 | 202 | M-2 | 425 | 72 | .07 |
| 103 | 203 | M-3 | 432 | 79 | .11 |
| 104 | 204 | M-4 | 422 | 82 | .16 |
| 105 | 205 | M-5 | 426 | 77 | .14 |
| 106 | 206 | M-6 | 426 | 74 | .10 |
| 107 | 207 | M-7 | 429 | 68 | .13 |
| 108 | 208 | M-10 | 437 | 85 | .16 |
| 109 | 209 | M-11 | 426 | 78 | .10 |

The data show that the couplers of the invention have shorter wavelengths of maximum absorption, narrower absorption bands, and less unwanted absorption at 500 nanometers than the comparison coupler, leading to dye hues of much greater purity. Such results were not expected by the inventors.

Processed Film Samples 301–309

Samples 301–309 were prepared by exposing the coatings of Examples 101–109 through a step wedge and processing as follows:

| Process Step | Time (min.) | Temp. (C.) |
|---|---|---|
| First developer | 6.00 | 35.8 |
| Water wash | 2.00 | 35.8 |
| Reversal bath | 2.00 | 35.8 |
| Color Developer | 6.00 | 35.8 |
| Conditioner | 2.00 | 35.8 |
| Bleach | 4.00 | 35.8 |
| Fixer | 4.00 | 35.8 |
| Water wash | 4.00 | 35.8 |

The processing solutions used in the above process had the following compositions (amounts per liter of solution):

| | |
|---|---|
| First Developer | |
| Aminotris(methylenephosphonic acid) pentasodium salt | 0.56 g |
| Diethylenetriaminepentaacetic acid pentasodium salt | 2.51 g |
| Potassium sulfite | 29.75 g |
| Sodium bromide | 2.34 g |
| Sodium thiocyanate | 1.00 g |
| Potassium iodide | 4.50 mg |
| Potassium hydroxide | 4.28 g |
| 4-Hydroxymethyl-4-methyl-1-phenyl-3-pyrazolidinone | 1.50 g |
| Potassium carbonate | 14.00 g |
| Sodium bicarbonate | 12.00 g |
| Potassium hydroquinone sulfonate | 23.40 g |
| Acetic acid | 0.58 g |
| pH adjusted to 9.60 at 26.7 C. | |
| Reversal Bath | |
| Propionic acid | 11.90 g |
| Stannous chloride | 1.65 g |
| p-Aminophenol | 0.50 mg |
| Sodium hydroxide | 4.96 g |
| Aminotris(methylenephosphonic acid-pentasodium salt | 8.44 g |
| Benzethonium chloride | 10.00 mg |
| pH adjusted to 5.75 at 26.7 C. | |
| Color Developer | |
| Aminotris(methylenephosphonic acid) pentasodium salt | 2.67 g |
| Phosphoric acid | 13.05 g |
| Sodium bromide | 0.65 g |
| Potassium iodide | 37.50 mg |
| Potassium hydroxide | 27.72 g |
| Sodium sulfite | 6.08 g |
| Sodium metabisulfite | 0.50 g |
| Citrazinic acid | 0.57 g |
| N-{2-[(4-amino-3-methylphenyl) ethylamino]-ethyl}methanesulfonamide, sesquisulfate | 10.42 g |
| 2,2'-(Ethylenedithio)diethanol | 0.87 g |
| Acetic acid | 1.16 g |
| Sodium carboxymethylcellulose 7LF (Hercules) | 0.95 g |
| Sodium carboxymethylcellulose 7H3SF (Hercules) | 0.71 g |
| pH adjusted to 11.75 ay 26.7 C. | |
| Bleach Accelerator | |
| Potassium sulfite | 9.00 g |
| Ethylenediaminetetraacetic acid | 5.00 g |
| Sodium formaldehyde bisulfite | 60.00 g |
| Thioglycerol | 0.52 mL |
| pH adjusted to 6.15 at 25 C. | |
| Bleach | |
| Potassium nitrate | 25.00 g |
| Ammonium bromide | 64.20 g |
| Ammonium ferric ethylenediaminetetra-acetate | 124.96 g |
| Ethylenediaminetetraacetic acid | 9.95 g |
| Hydrobromic acid | 24.58 g |
| Ethylenedinitrilotetraacetic acid | 4.00 g |
| Potassium hydroxide | 1.74 g |
| Fixer | |
| Ammonium thiosulfate | 13.93 g |
| Ammonium sulfite | 0.99 g |
| Ethylenedinitrilotetraacetic acid | 0.59 g |
| Sodium metabisulfite | 7.12 g |
| Sodium hydroxide | 1.00 g |

The spectra of the resulting dyes were measured and normalized to a maximum absorption of 1.00. The wavelength in nanometers at maximum absorption, bandwidth in nanometers at 50% peak height, and the absorption at 500 nanometers (Abs@500) are shown in Table 2.

TABLE 2

| Coating Example | Processed Sample | Coupler | Abs. Max. (nm) | Bandwidth (nm) | Abs @ 500 |
|---|---|---|---|---|---|
| 101 | 301 | CC-1 | 446 | 90 | 0.30 |
| 102 | 302 | M-2 | 426 | 84 | 0.10 |
| 103 | 303 | M-3 | 430 | 86 | 0.11 |
| 104 | 304 | M-4 | 421 | 84 | 0.15 |
| 105 | 305 | M-5 | 420 | 78 | 0.22 |
| 107 | 307 | M-7 | 429 | 74 | 0.16 |
| 108 | 308 | M-10 | 432 | 90 | 0.16 |
| 109 | 309 | M-11 | 427 | 82 | 0.10 |

The data show that the couplers of the invention have shorter and narrower absorption bands and less unwanted absorption at 500 nanometers than the comparison coupler, leading to dye hues of much greater purity. Such results were not expected by the inventors.

Paper Coating Example 401 (Comparison)

On a polyethylene-laminated paper support were coated the following layers:

First Layer

An underlayer containing 3.23 grams gelatin per square meter.

Second Layer

A blue-sensitive emulsion layer comprising 1.61 grams gelatin, 0.28 grams silver chloride emulsion (expressed as silver), $1.18\times10^{-6}$ mole (1.08 grams) comparison coupler CC-1, 0.33 gram 2,2'-methylenebis(6-t-butyl-4-methylphenol) monoacetate (stabilizer), 0.33 gram 2-(2-butoxyethoxy)ethyl acetate (solvent), and 0.33 gram dibutyl phthalate (solvent) per square meter.

Third Layer

A protective layer containing 1.33 grams gelatin, 0.73 gram 2-(2H-benzotriazol-2-yl)-4,6-bis(1,1-dimethylpropyl) phenol, and 0.13 gram 2-{(2-hydroxy-3-3-(1,1-dimethylethyl)-5-methyl)phenyl}-5-chlorobenzotriazole per square meter.

Fourth Layer

A protective layer containing 1.40 grams gelatin and 0.14 gram bis(vinylsulfonylmethyl) ether per square meter.

Paper Coating Examples 402–404 (Invention)

The couplers of the invention shown in Table 3, Samples 401–404, were coated in the same manner as the comparison coupler in Coating Example 401, except that the Second Layer of each coating contained 0.56 grams emulsion and $1.18\times10^{-6}$ mole coupler per square meter, and stabilizer and solvents in the same proportions by weight of coupler. (The amount of emulsion was increased to adjust for the equivalency of the couplers.)

Paper Coating Examples 405–408 (Invention).

Sample 405 was prepared in the same manner as Sample 401, except that the Second Layer contained 1.61 grams gelatin, 0.28 grams silver chloride emulsion (expressed as silver), $1.18\times10^{-6}$ mole (1.08 grams) comparison coupler CC-1, 0.27 gram 2,2'-methylenebis(6-t-butyl-4-methylphenol) monoacetate (stabilizer), 0.31 gram 2-(2-butoxyethoxy)ethyl acetate (solvent), and 0.37 gram dibutyl phthalate (solvent) per square meter. Samples 406–408 were prepared in the same manner as Sample 405 except that they contained 0.56 grams emulsion and $1.18\times10^{-6}$ mole coupler per square meter, and stabilizer and solvents in the same proportions by weight of coupler as in Sample 405.

Processed Paper Samples 501–508

Samples 501–508 were prepared by exposing the coatings of Examples 401–408 through a step wedge and processing as follows:

| Process Step | Time (min.) | Temp. (C.) |
|---|---|---|
| Developer | 0.75 | 35.0 |
| Bleach-Fix | 0.75 | 35.0 |
| Water wash | 1.50 | 35.0 |

The processing solutions used in the above process had the following compositions (amounts per liter of solution):

| Developer | |
|---|---|
| Triethanolamine | 12.41 g |
| Blankophor REU (Mobay Corp.) | 2.30 g |
| Lithium polystyrene sulfonate | 0.09 g |
| N,N-Diethylhydroxylamine | 4.59 g |
| Lithium sulfate | 2.70 g |
| N-{2-[(4-amino-3-methylphenyl) ethylamino]-ethyl}methanesulfonamide, sesquisulfate | 5.00 g |
| 1-Hydroxyethyl-1,1-diphosphonic acid | 0.49 g |
| Potassium carbonate, anhydrous | 21.16 g |
| Potassium chloride | 1.60 g |
| Potassium bromide | 7.00 mg |
| pH adjusted to 10.4 at 26.7 C. | |
| **Bleach-Fix** | |
| Solution of ammonium thiosulfate | 71.85 g |
| Ammonium sulfite | 5.10 g |
| Sodium metabisulfite | 10.00 g |
| Acetic acid | 10.20 g |
| Ammonium ferric ethylenediamine tetraacetate | 48.58 g |
| Ethylenediaminetetraacetic acid | 3.86 g |
| pH adjusted to 6.7 at 26.7 C. | |

The spectra of the resulting dyes were measured and normalized to a maximum absorption of 1.00. The wavelength of maximum absorption and the absorption at 500 nanometers (Abs@500) are shown in Table 3.

TABLE 3

| Coating Example | Processed Sample | Coupler | Max. abs (nm) | Abs-500 |
|---|---|---|---|---|
| 401 | 501 | CC-1 | 447 | 0.52 |
| 402 | 502 | M-1 | 420 | 0.24 |
| 403 | 503 | M-2 | 428 | 0.19 |
| 404 | 504 | M-3 | 426 | 0.22 |
| 405 | 505 | CC-1 | 443 | 0.49 |
| 406 | 506 | M-2 | 425 | 0.16 |
| 407 | 507 | M-4 | 422 | 0.16 |
| 408 | 508 | M-5 | 425 | 0.30 |

The data show that the couplers of the invention have a wavelength of maximum absorption which is less than the comparison and have less unwanted absorption at 500 nanometers than the comparison coupler, leading to dye hues of much greater purity. Again, such results had not been expected by the inventors.

The advantageous absorption spectra of the couplers of the invention are illustrated in FIG. 1, which shows the spectra of the dyes in Processed Samples 501 (curve 2—comparison coupler CC-1) and 503 (curve 1—inventive coupler M-2). The comparison curve thus has a maximum absorption at about 447 nm while the inventive sample has a maximum at 420 nm. At the same time the unwanted optical density of the comparison curve at 500 nm is 0.52, while the inventive sample exhibits a much lower value of 0.19.

What is claimed is:

1. A photographic material comprising at least one light sensitive silver halide emulsion layer having associated therewith a yellow dye forming coupler having formula (I) or (II):

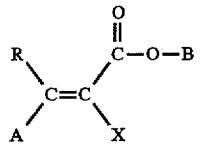

(I)

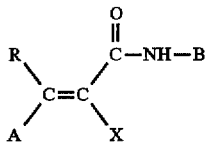

(II)

wherein

R represents an aromatic or heterocyclic group containing a group ionizable at DH 10 that is in conjugation with the double bond between the carbon atoms to which A and X are respectively bonded through a π-electronic network;

A is selected from the group consisting of hydrogen, a cyano group, an alkyl group, an aryl group, an alkylsulfonyl group, and an arylsulfonyl group;

B is an alkyl group or an aryl group; and

X represents hydrogen or a group capable of being split off upon coupling with oxidized color developer.

2. The material of claim 1 wherein the ionizable group is selected from the group consisting of hydroxy, sulfonamido, and heterocyclicamino groups.

3. The material of claim 2 wherein the ionizable group is selected from the group consisting of hydroxy and sulfonamido.

4. The material of claim 1 wherein R is an aromatic group.

5. The material of claim 4 wherein R is selected from the group consisting of 2-hydroxyphenyl, 4-hydroxyphenyl, 2-sulfonamidophenyl, 4-sulfonamidophenyl, 4-hydroxynaphthyl, 4-sulfonamidonaphthyl, and 3-indolyl groups.

6. The material of claim 1 wherein R is a hydroxyphenyl group.

7. The material of claim 1 wherein R is a heterocyclic group.

8. The material of claim 7 wherein R is selected from the group consisting of 4-pyrazolyl, 3-pyrazolotriazolyl, and 7-pyrazolyltriazolyl groups.

9. The material of claim 1 wherein A is hydrogen.

10. The material of claim 1 wherein A is selected from the group consisting of cyano, trifluoromethyl, pentafluoroethyl, heptafluoropropyl, methyl, ethyl, octadecyl, phenyl, 4-cyanophenyl, 4-methoxyphenyl, pentafluorophenyl, methylsulfonyl, butylsulfonyl, dodecylsulfonyl, phenylsulfonyl and dodecyloxyphenylsulfonyl groups.

11. The material of claim 1 wherein A is a cyano group.

12. The material of claim 1 wherein B is an unsubstituted alkyl group.

13. The material of claim 1 wherein B is a phenyl group.

14. The material of claim 13 wherein the phenyl group is substituted.

15. The material of claim 1 wherein B is selected from the group consisting of methyl, t-butyl, octadecyl, trifluoromethyl, phenyl, 2-tetradecyloxyphenyl, 2-chloro-5-dodecyloxycarbonylphenyl, pentafluorophenyl, 4-(2,4-di-tpentylphenoxy)butyl, and 2,4-di-t-butylphenyl groups.

16. The material of claim 1 wherein X is hydrogen.

17. The material of claim 1 wherein X is a PUG (photographically useful group) or a PUG releasing group.

18. The material of claim 17 wherein X contains a timing group.

19. The material of claim 1 wherein X has the formula:

$$-(TG)_x\text{-PUG}$$

wherein TG is a timing group clearable from the rest of the coupler during processing;

x is 0, 1, 2, or 3; and PUG is a releasable photographically useful group.

20. The material of claim 1 wherein X is selected from the group consisting of halogen, aryloxy, alkyloxy, arylthio, alkylthio, heterocyclylthio, and heterocyclic groups.

21. The material of claim 1 wherein the photographic material contains the yellow dye-forming coupler in or associated with a blue light sensitive silver halide emulsion layer.

* * * * *